US009062445B2

(12) United States Patent
Duncan et al.

(10) Patent No.: US 9,062,445 B2
(45) Date of Patent: Jun. 23, 2015

(54) WAX FREE KIT FOR NEW AND EXISTING CONSTRUCTION

(71) Applicants: Scott E Duncan, Santa Rosa, CA (US); Lorae A Fistor, Santa Rosa, CA (US)

(72) Inventors: Scott E Duncan, Santa Rosa, CA (US); Lorae A Fistor, Santa Rosa, CA (US)

( * ) Notice: Subject to any disclaimer, the term of this patent is extended or adjusted under 35 U.S.C. 154(b) by 310 days.

(21) Appl. No.: 13/761,835

(22) Filed: Feb. 7, 2013

(65) Prior Publication Data

US 2014/0041108 A1 Feb. 13, 2014

Related U.S. Application Data

(60) Provisional application No. 61/596,044, filed on Feb. 7, 2012.

(51) Int. Cl.
*E03D 11/16* (2006.01)

(52) U.S. Cl.
CPC ..... *E03D 11/16* (2013.01)

(58) Field of Classification Search
CPC ..... E03D 11/16; E03D 11/17
See application file for complete search history.

(56) References Cited

U.S. PATENT DOCUMENTS

| | | | | |
|---|---|---|---|---|
| 1,335,056 | A | 3/1920 | Hinsdale | |
| 1,594,350 | A | 8/1926 | Boosey | |
| 4,827,539 | A * | 5/1989 | Kiziah | 4/252.4 |
| 5,432,957 | A * | 7/1995 | Fernie et al. | 4/252.4 |
| 5,898,954 | A * | 5/1999 | Provenzano | 4/252.1 |
| 6,065,160 | A * | 5/2000 | Winn | 4/252.1 |
| 6,381,775 | B1 * | 5/2002 | Sondrup | 4/679 |
| 6,519,784 | B2 * | 2/2003 | Carwile | 4/252.5 |
| 6,634,034 | B2 * | 10/2003 | Rendell | 4/252.4 |
| 6,789,275 | B2 | 9/2004 | Spells et al. | |
| 7,188,376 | B2 * | 3/2007 | Ortiz et al. | 4/252.5 |
| 2001/0045710 | A1 * | 11/2001 | Nguyen et al. | 277/604 |
| 2002/0023294 | A1 * | 2/2002 | Spells, Sr. | 4/252.6 |
| 2003/0033662 | A1 | 2/2003 | Spells et al. | |
| 2005/0035558 | A1 | 2/2005 | Dipzinski et al. | |
| 2005/0050623 | A1 * | 3/2005 | Greene | 4/252.4 |
| 2005/0108814 | A1 * | 5/2005 | Thompson | 4/252.6 |
| 2006/0143813 | A1 * | 7/2006 | Reier et al. | 4/252.1 |
| 2010/0123307 | A1 * | 5/2010 | Coronado | 285/56 |
| 2011/0185487 | A1 * | 8/2011 | Miller et al. | 4/252.5 |
| 2014/0366256 | A1 * | 12/2014 | Coronado | 4/252.6 |

* cited by examiner

*Primary Examiner* — Tuan N Nguyen
*Assistant Examiner* — William R Klotz
(74) *Attorney, Agent, or Firm* — Steven A. Nielsen; www.NielsenPatents.com

(57) ABSTRACT

A wax free toilet installation kit allows plumbers to approach new construction and old closet flanges with one economical and efficient set of parts that will work with both three and four inch soil pipes. A new threaded adapter sleeve 100 fits into both three and four inch traditional closet flanges to retrofit old wax system installations. The threaded adapter sleeve has a threaded body 110 to accommodate a variety of height adjustment nuts, which include a compact adjustment nut 125 and a lip and valley expanded adjustment nut 128. A new male female pipe coupler 200 may be used in new construction and comports with both three and four inch soil pipes. The threaded adapter sleeve 100 fits into the male female pipe coupler 200. The threaded adapter sleeve is quickly adjusted to accommodate varying floor heights.

1 Claim, 22 Drawing Sheets

100

200

WAX FREE KIT FOR NEW AND EXISTING CONSTRUCTION

CROSS-REFERENCE TO RELATED APPLICATIONS

This is a utility application based upon U.S. patent application Ser. No. 61/596,044 filed on Feb. 7, 2012. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

BACKGROUND OF THE INVENTION (1) Field of the Invention

The invention generally relates to wax free toilet installation systems. More particularly, the invention relates to wax free means and methods of attaching a soil pipe to a toilet in new construction or in a retro fit configuration.

(2) Related Art

Other wax free toilet installation systems and sleeve type configurations are known in the related art. But, the related art fails to provide a kit system providing a plumber means and methods of applying an adjustable height wax free system in either new construction and for a retro fit application using a single threaded adapter sleeve.

The prior art fails to disclose, anticipate or suggest the use of lower seals to stop the flow of sewer gasses. For example, U.S. Pat. Nos. 1,335,056 and 1,594,350 would not be code compliant in modern construction, as the two patents fail to provide for, inter alia, sewer gas stoppage as now required in all current building codes.

The prior art also fails to teach, disclose or suggest a new closet flange system or male female pipe coupler for new home construction that integrates with the disclosed threaded adapter sleeve.

BRIEF SUMMARY OF THE INVENTION

The present invention overcomes shortfalls in the related art by presenting an unobvious and unique combination and configuration of sleeves, threads, mechanical attachments, adjustment nuts, threaded adapter sleeves, male female pipe couplers, and other components to artfully attach a toilet to a prior art closet flange for a retro fit application and to install a new male female pipe coupler to a soil pipe in new home construction.

The present invention overcomes shortfalls in the prior art by presenting a kit system that enables a plumber to retro fit an older wax seal system with the disclosed wax free system while using an existing prior art closet flange. In the prior art, converting a prior art closet flange to a wax free system required the use of many parts and intensive labor. The present invention integrates several prior art components into a few multi-function components that provide lower labor and part costs. The new multi-function components include a new threaded adapter sleeve that works with both prior art closet flanges and the disclosed male female pipe coupler.

In a retro fit application, a plumber is presented with an existing prior art closet flange that is either three inches or four inches in diameter. With the present invention, a plumber may remove an old wax seal system and insert the disclosed threaded adapter sleeve into the existing three inch or four inch prior art closet flange.

The disclosed threaded adapter sleeve comes with various adjustment nuts and seals to quickly adjust the mounting face of the threaded adapter sleeve to the correct height. Since the disclosed threaded adapter sleeve works with both three inch and four inch prior art closet flanges, less parts need to be stocked by a plumber. The disclosed threaded adapter sleeve provides for quick and nondestructive height adjustments that are often needed in bathroom remodeling projects where finished floor heights are often subject to a home owner's fluid design choices.

For new construction, the same threaded adapter sleeve seamlessly integrates into the disclosed male female pipe coupler. When a plumber is called to a job site, the plumber does not know if a three inch or four inch soil pipe will be found. In the prior art, a plumber would need to stock and carry both three inch and four inch closet flanges. The present invention overcomes this shortfall in the art by disclosure of a new male female pipe coupler that works with both three inch and four inch soil pipes.

The disclosed male female pipe coupler works with the disclosed threaded adapter sleeve and provides advantages over the prior art closet flanges. The disclosed male female pipe coupler includes various advantages over the prior art closet flanges.

These and other objects and advantages will be made apparent when considering the following detailed specification when taken in conjunction with the drawings.

BRIEF DESCRIPTION OF THE DRAWINGS

FIGS. 5 to 23 present various views of various embodiments of the invention.

REFERENCE NUMERALS IN THE DRAWINGS

Figure 1:
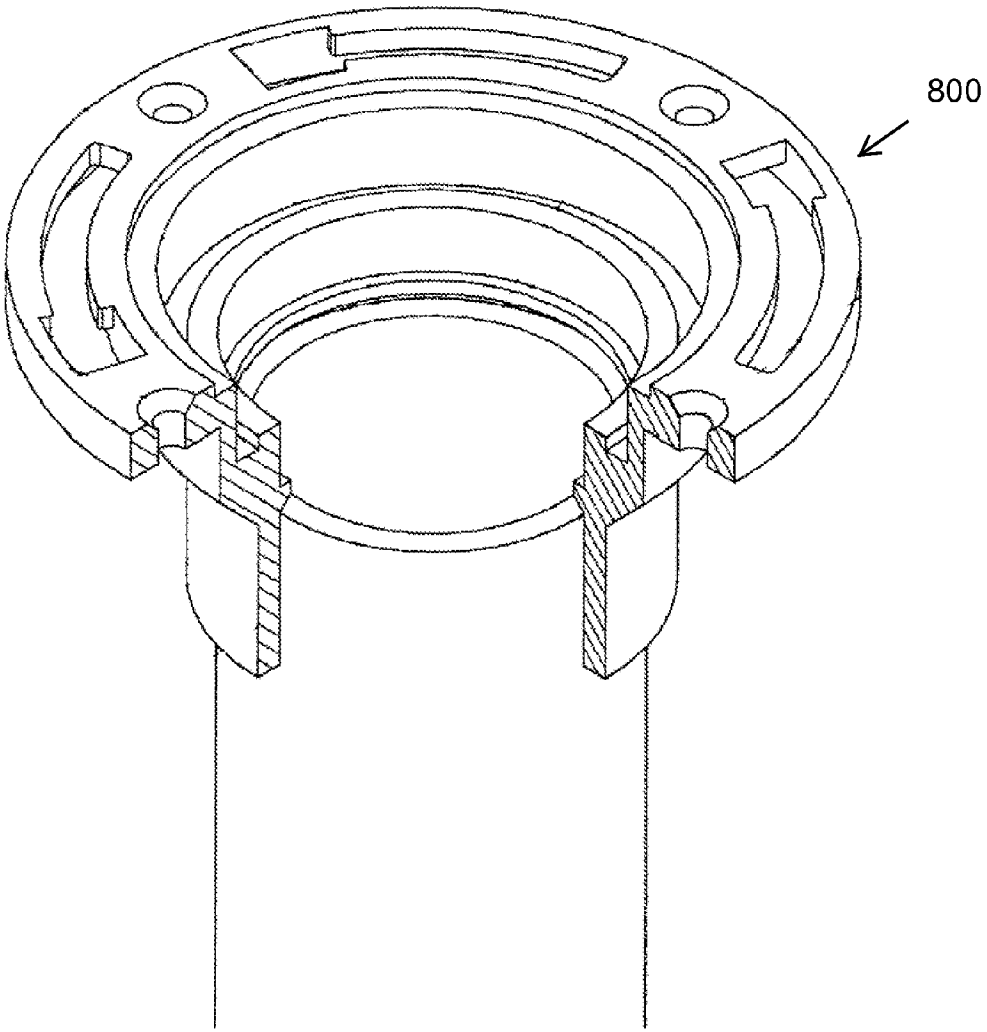
Fig 1 Prior Art
FIG. 1 depicts a prior art closet flange

100 threaded adapter sleeve
110 threaded body of threaded adapter sleeve 100
111 lower shoulder of threaded adapter sleeve
112 threaded seal holder, threads of body
115 upper shoulder of threaded adapter sleeve
116 seat seal area
117 upper ledge of threaded adapter sleeve
118 lower edge of threaded adapter sleeve
125 compact adjustment nut, sometimes used with prior three inch art closet flange and the disclosed male female pipe coupler 200
126 recessed outer seat of compact adjustment nut 125, the seat mates with the tapered recess area 210 of male female pipe coupler 200
127 compact seal, sometimes used with prior three inch art closet flange and the disclosed male female pipe coupler 200
128 lip and valley expanded adjustment nut, fits upon the threaded adapter sleeve and is sometimes used with four inch prior art closet flanges
129 expanded seal, fits upon the threaded adapter sleeve and is sometimes used with four inch prior art closet flanges
130 bowl seal sometimes attached to a threaded adapter sleeve
140 pipe seal sometimes attached to lower end of threaded adapter sleeve
150 upper shelf of a lip and valley expanded adjustment nut
151 transition wall of a lip and valley expanded adjustment nut
152 lower shelf of a lip and valley expanded adjustment nut
153 threads of inner void of a lip and valley expanded adjustment nut
154 outer perimeter wall of a lip and valley expanded adjustment nut
155 inner void of a lip and valley expanded adjustment nut
200 male female pipe coupler
210 tapered recess area of male female pipe coupler
220 upper shelf of male female pipe coupler
225 upper surface of male female pipe coupler
230 upper threads of male female pipe coupler
235 lower threads of male female pipe coupler
240 multi adapter collar of male female pipe coupler
500 a plumbing soil pipe sometimes three inches in diameter
510 a plumbing soil pipe sometimes four inches in diameter
600 floor surface
700 pressure test cap
800 prior art closet flange sometimes found in existing construction
900 Toilet flange

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines such terms.

FIG. 1 presents a prior art closet flange 800. A prior art closet flange whether 3 inch or four inch will work with the disclosed threaded adapter sleeve. The drawing of FIG. 1 is an amended copy from FIG. 6 of U.S. Published Patent Application 2002/0166161.

Figure 2:
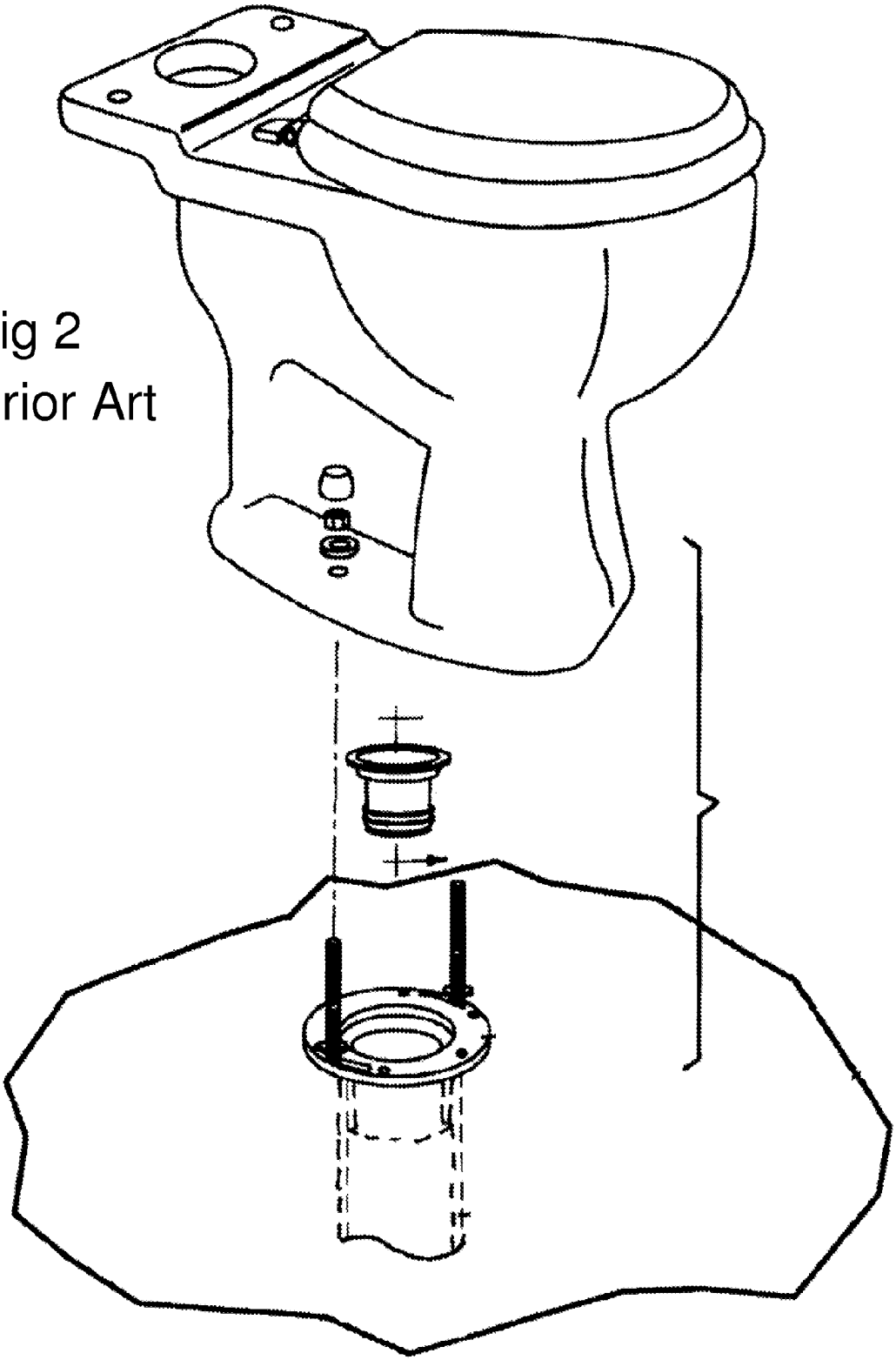
Fig 2 Prior Art
FIG. 2 depicts a prior art toilet to closet flange assembly

FIG. 2 presents an amended copy of FIG. 1 from U.S. Published Patent Application 2005/0035558 and is presented to show a general configuration of a toilet placed over a sleeve and over a prior art closet flange.

Figure 3:
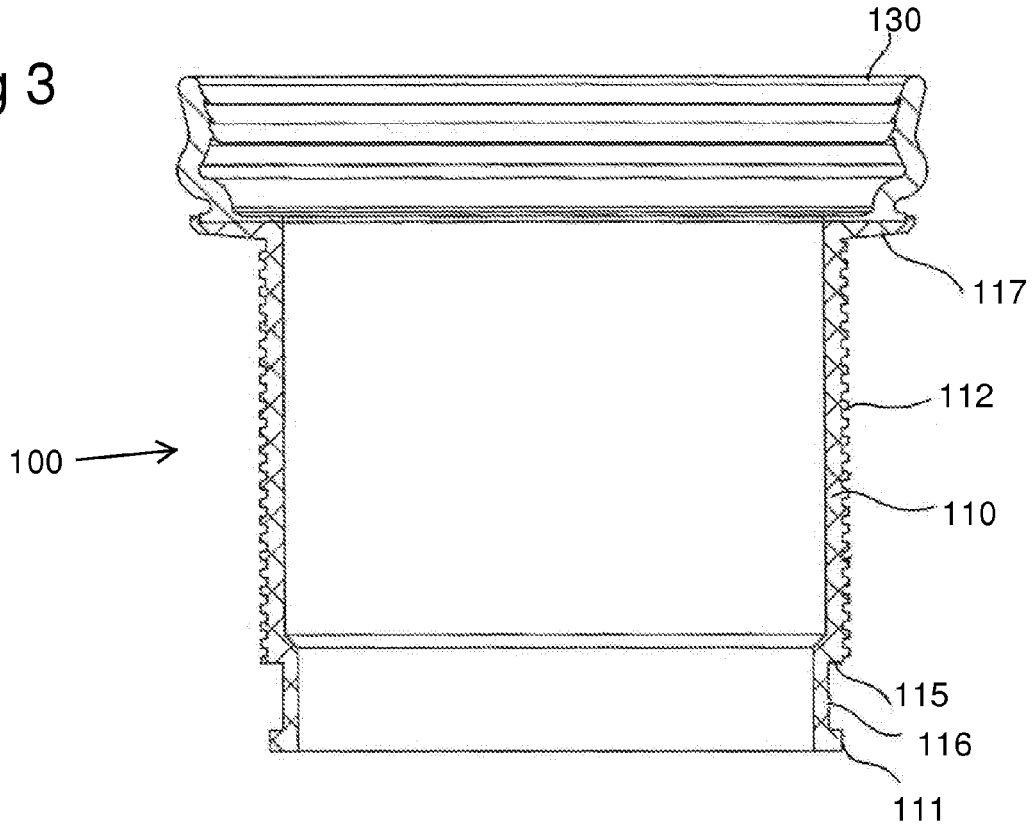
FIG. 3 depicts a threaded adapter sleeve

FIG. 3 depicts a disclosed threaded adapter sleeve 100 comprising a bowl seal 130, upper ledge of threaded adapter sleeve 117, threaded body 110, a lower shoulder 111, a seat seal area 116, an upper shoulder 115, a threaded seal holder 112 and other components.

Figure 4:
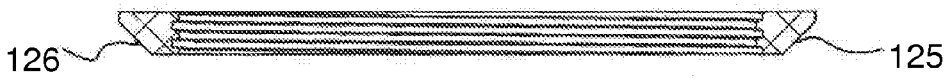
FIG. 4 depicts a compact adjustment nut

FIG. 4 depicts a section view of a compact adjustment nut 124.

Figure 5:
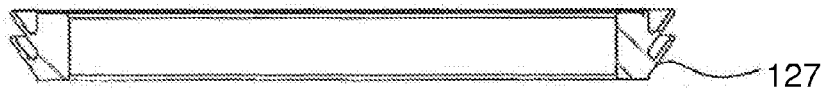
FIG. 5 depicts a compact seal

FIG. 5 depicts a section view of a compact seal.

Figure 6:
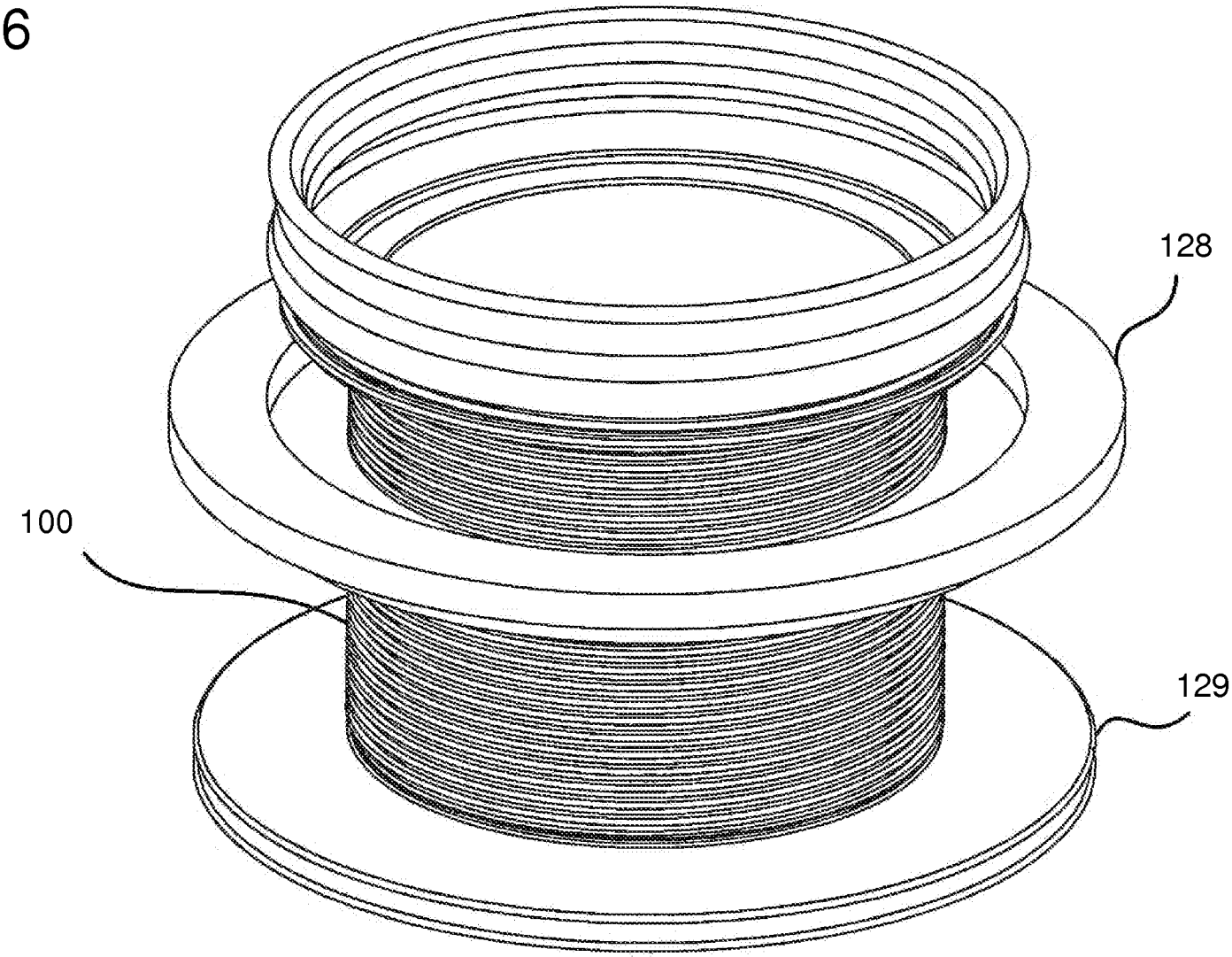
FIG. 6 depicts a threaded adapter sleeve

FIG. 6 depicts a threaded seal holder configured for use with a four inch prior art closet flange. Such a configuration may include a lip and valley expanded adjustment nut 128 and an expanded seal 129.

Figure 7:
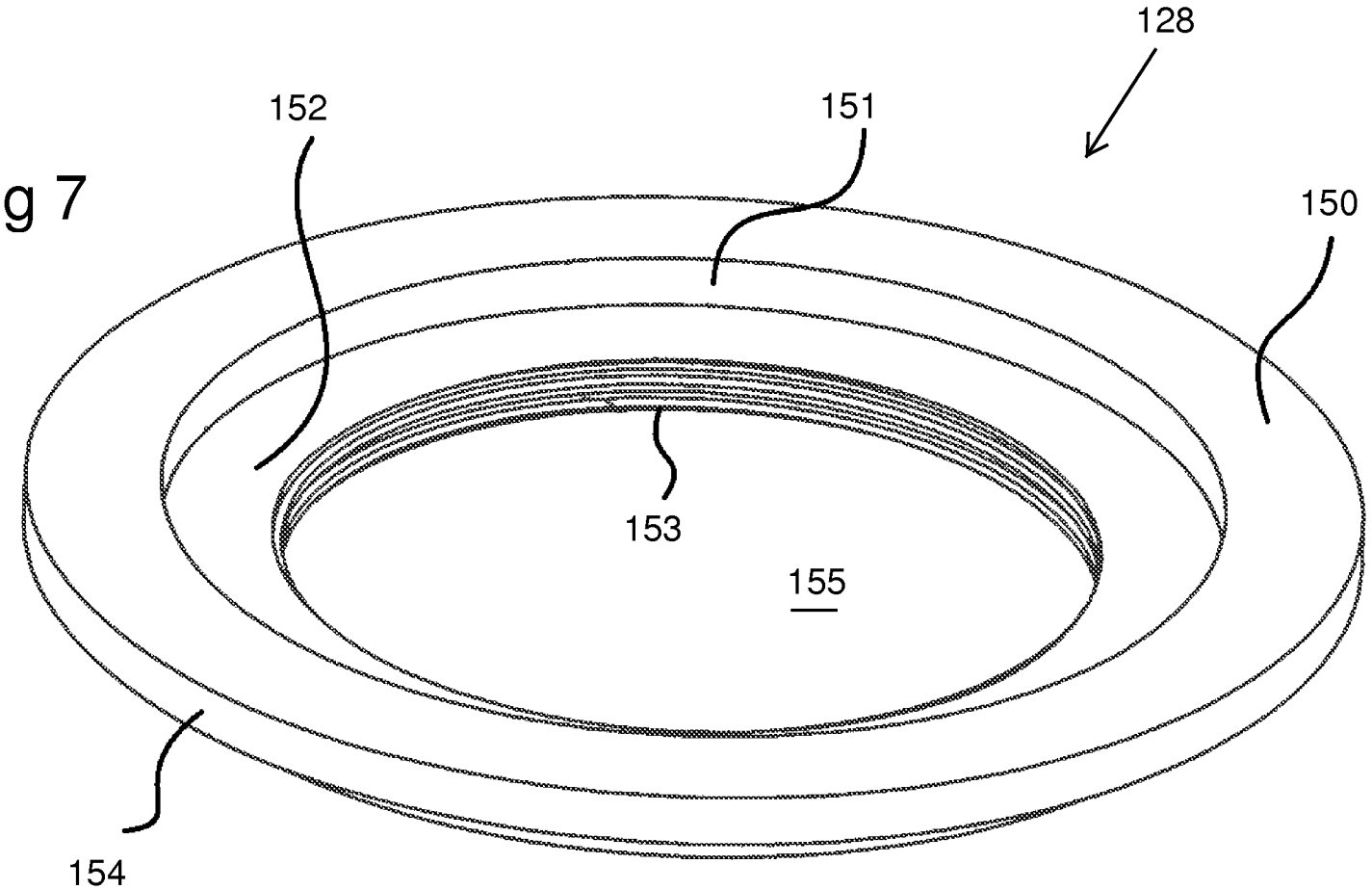
FIG. 7 depicts a lip and valley expanded adjustment nut

FIG. 7 depicts a various features and components of a lip and valley expanded adjustment nut 128.

Figure 8:
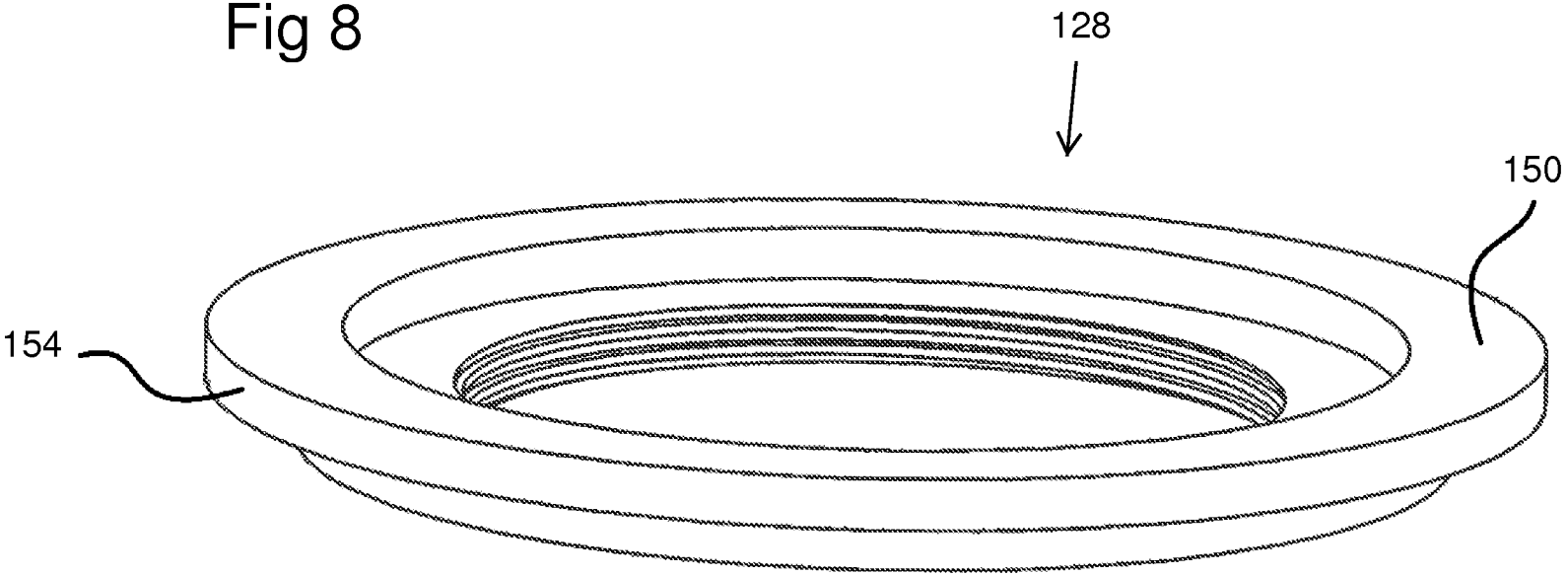
FIG. 8 depicts a lip and valley expanded adjustment nut

FIG. 8 depicts another view of a lip and valley expanded adjustment nut 128.

Figure 9:
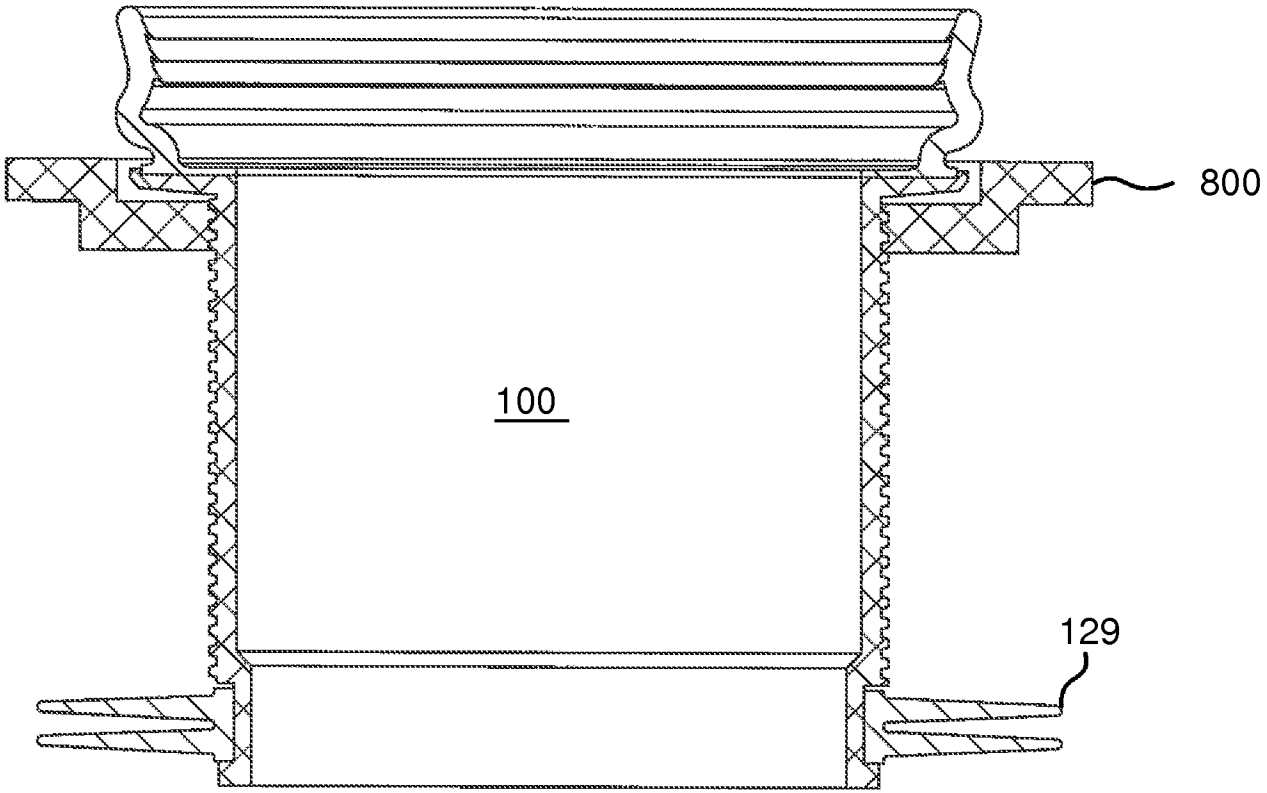
FIG. 9 depicts a threaded adapter sleeve

FIG. 9 depicts a threaded adapter sleeve.

Figure 10:
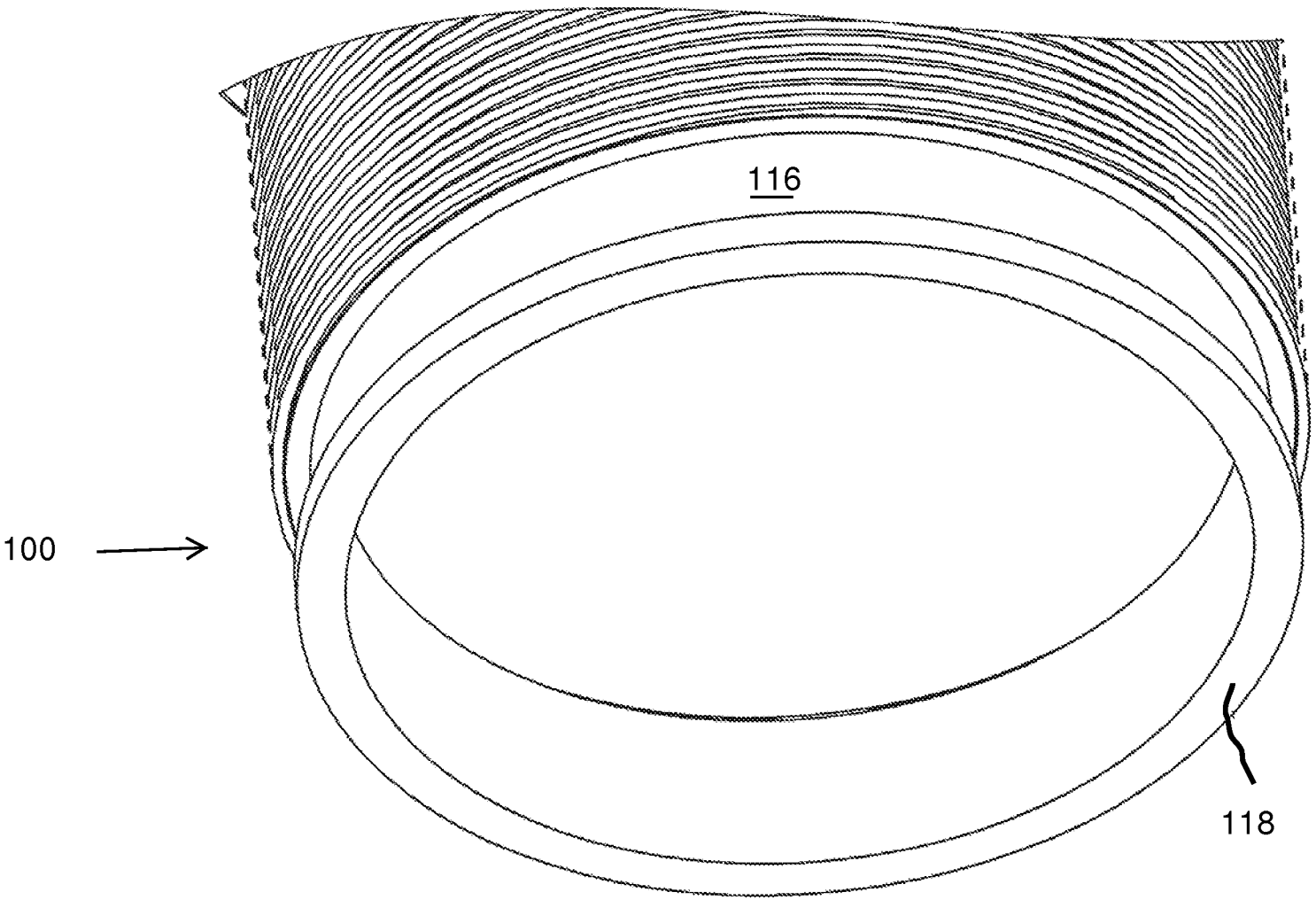
FIG. 10 depicts a lower section of a threaded adapter sleeve

FIG. 10 depicts an expanded lower view of a threaded adapter sleeve 100 and shows a seat seal area 116 and a lower edge 118. The seat seal area will accept either an expanded seal 129 or a compact seal 127.

Figure 11:
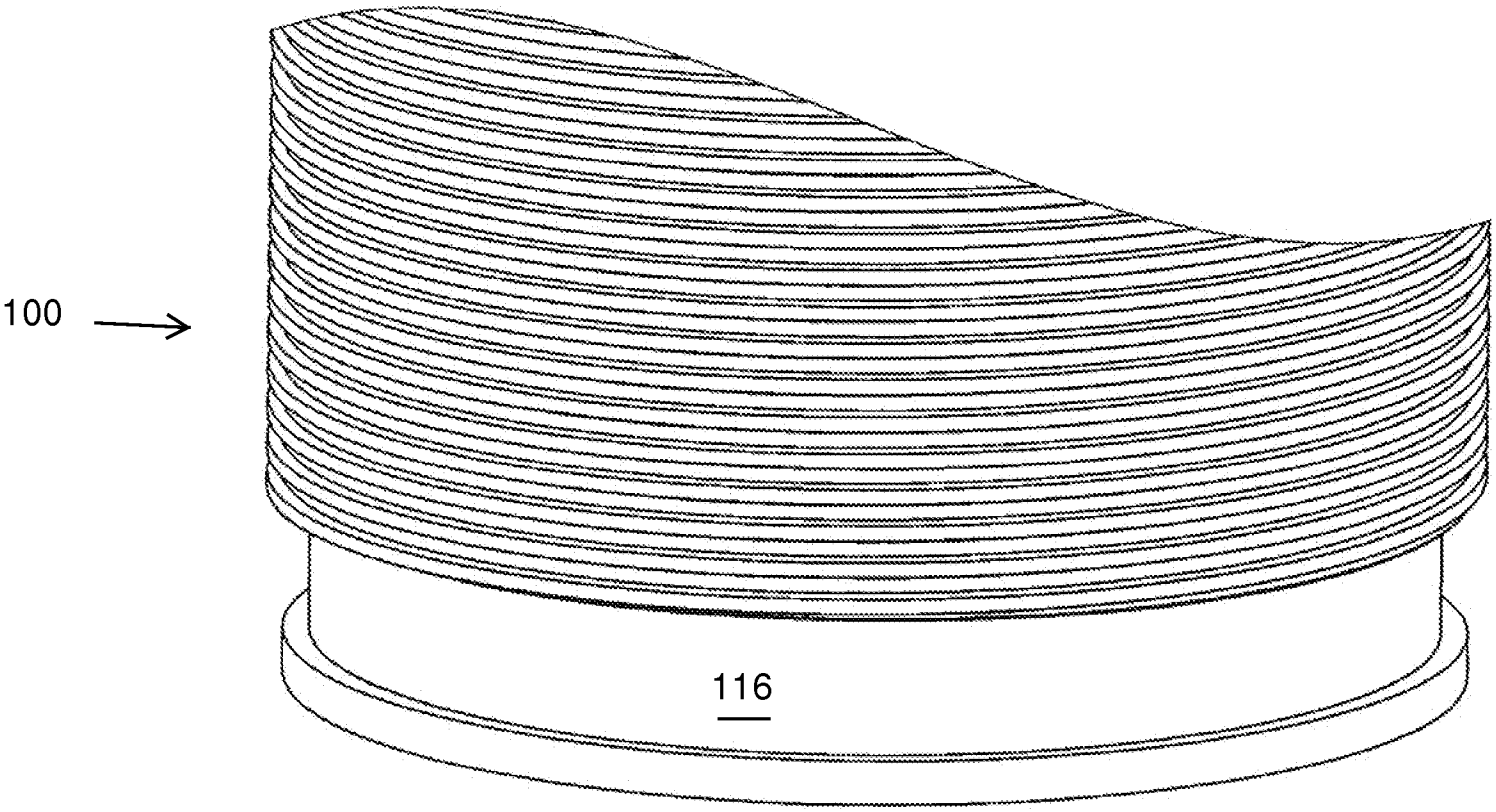
FIG. 11 depicts a lower section of a threaded adapter sleeve

FIG. 11 depicts an expanded lower view of a threaded adapter sleeve 100

Figure 12:
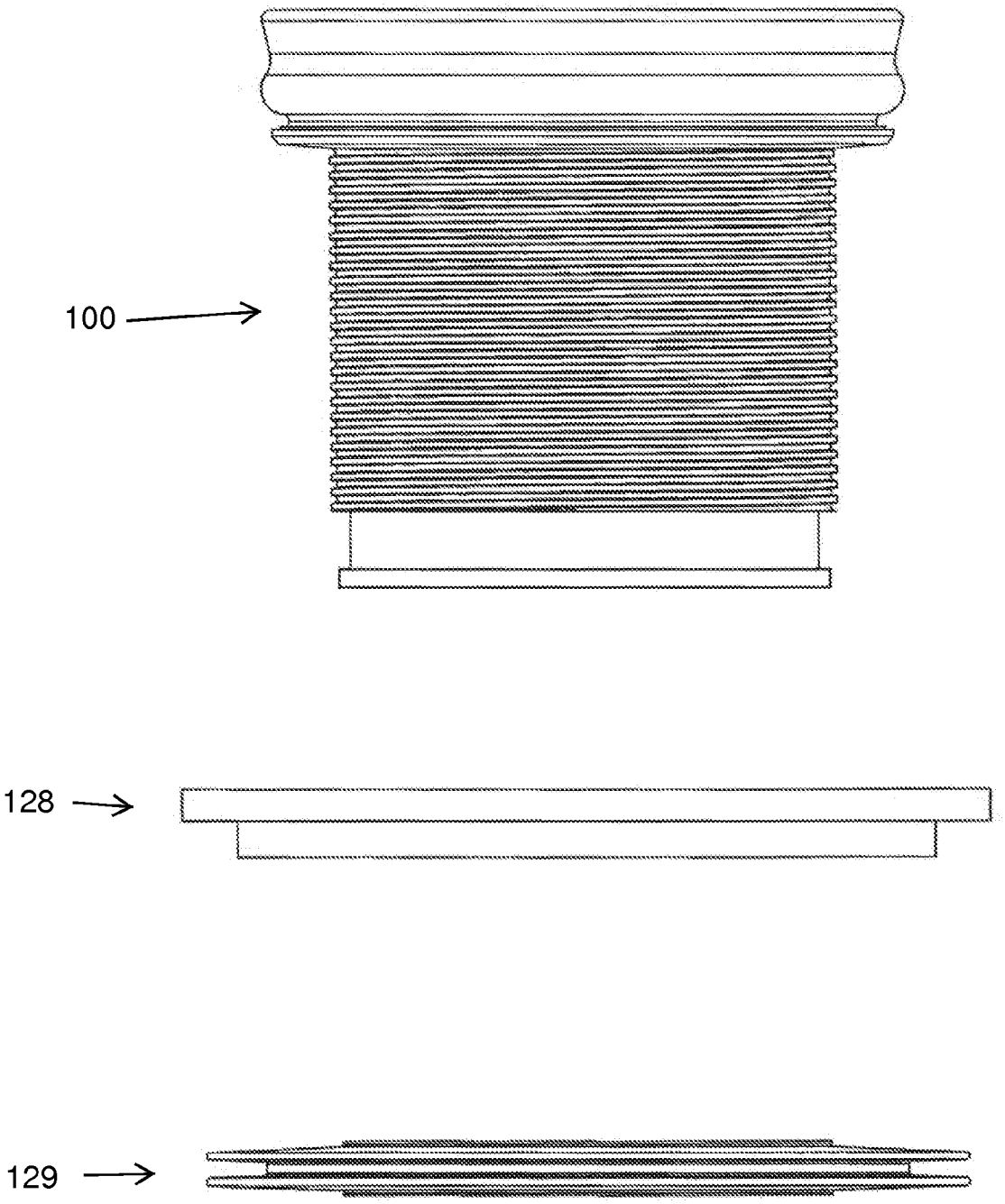
FIG. 12 depicts a threaded adapter sleeve with other components

FIG. 12 depicts a threaded adapter sleeve 100 and other components suitable for use with a wax free installation with a four inch prior art closet flange.

Figure 13:
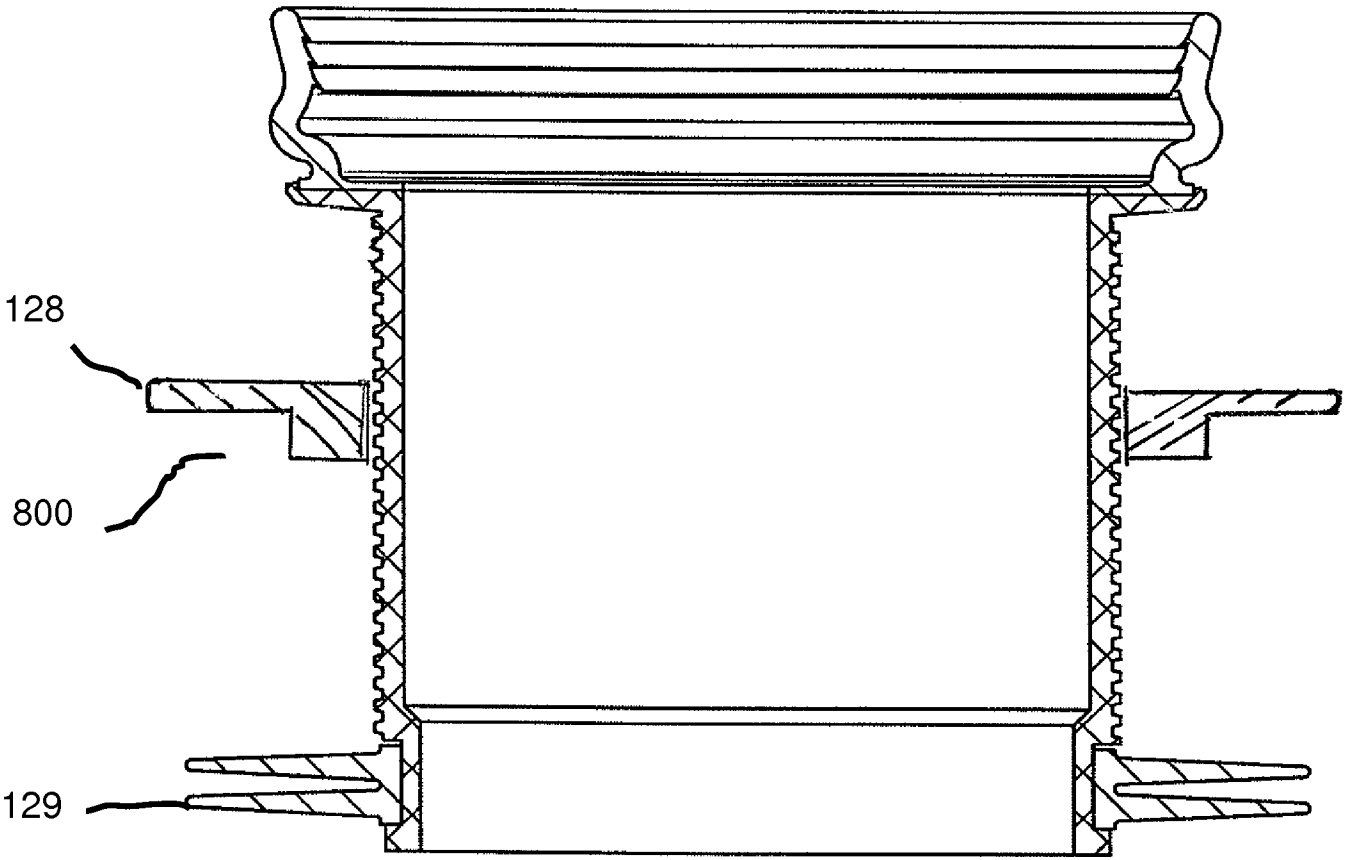
FIG. 13 depicts a threaded adapter sleeve used with a prior art closet flange

FIG. 13 depicts an adjustment configuration in a retro fit application.

Figure 14:
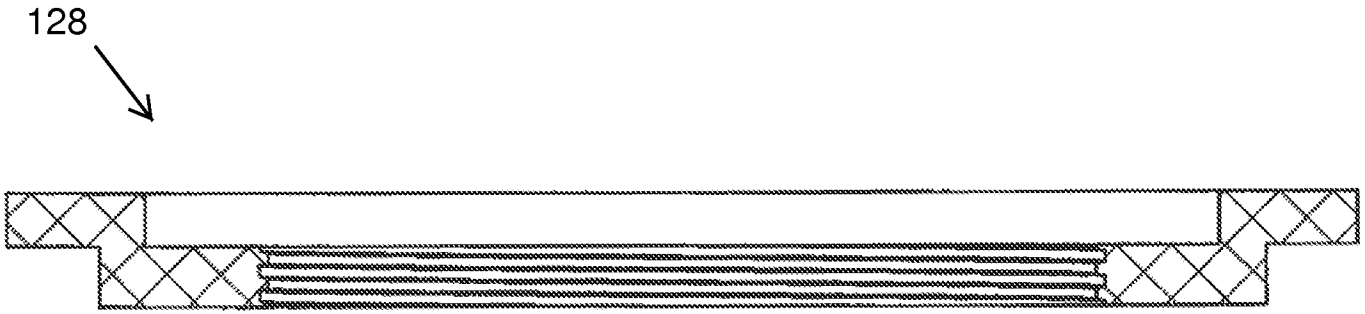
FIG. 14 depicts a sectional view of a lip and valley expanded adjustment nut

FIG. 14 depicts a section view of a lip and valley expanded adjustment nut 128.

Figure 15:
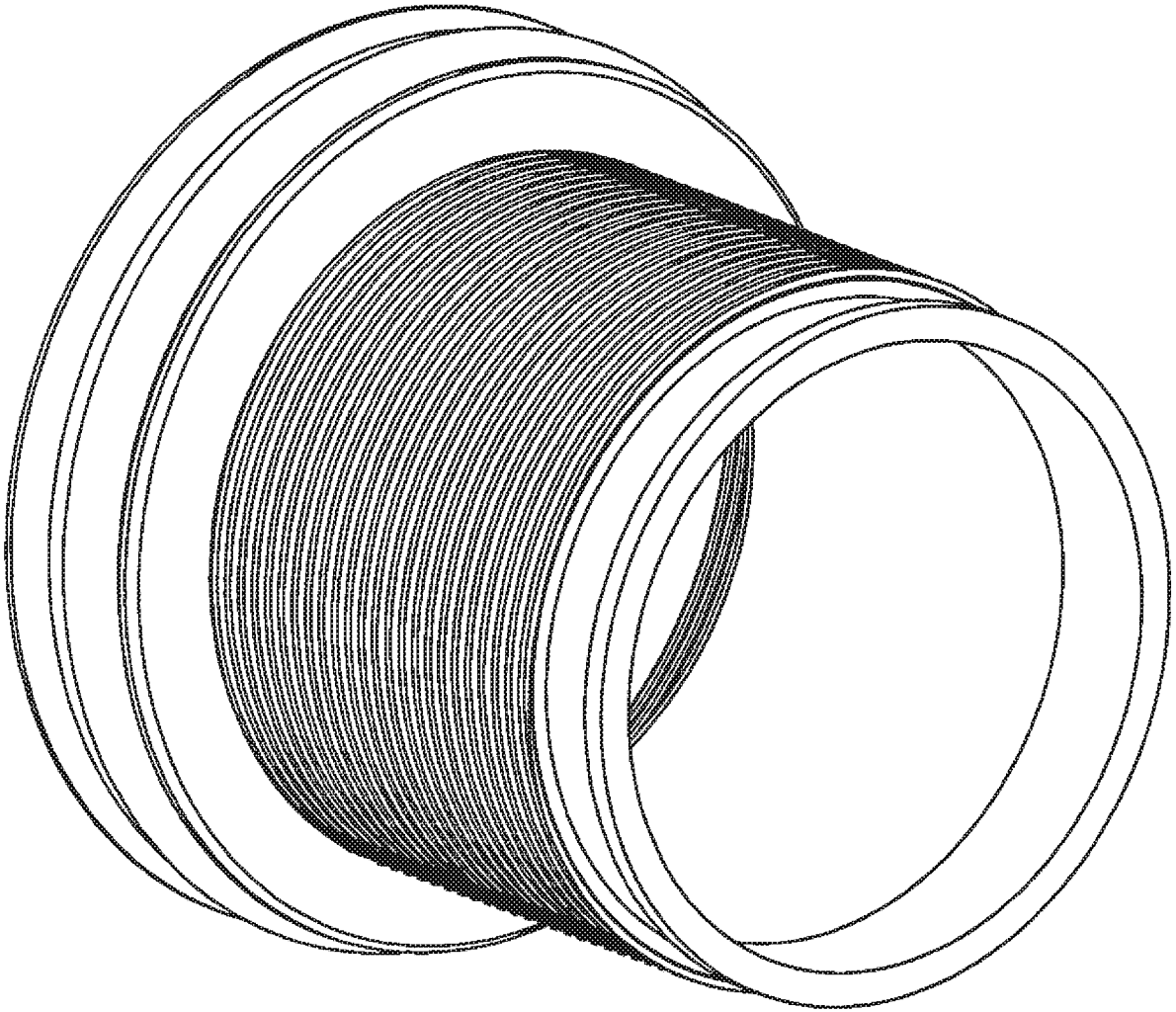
FIG. 15 depicts a threaded adapter sleeve

FIG. 15 depicts a disclosed threaded adapter sleeve 100.

Figure 16:
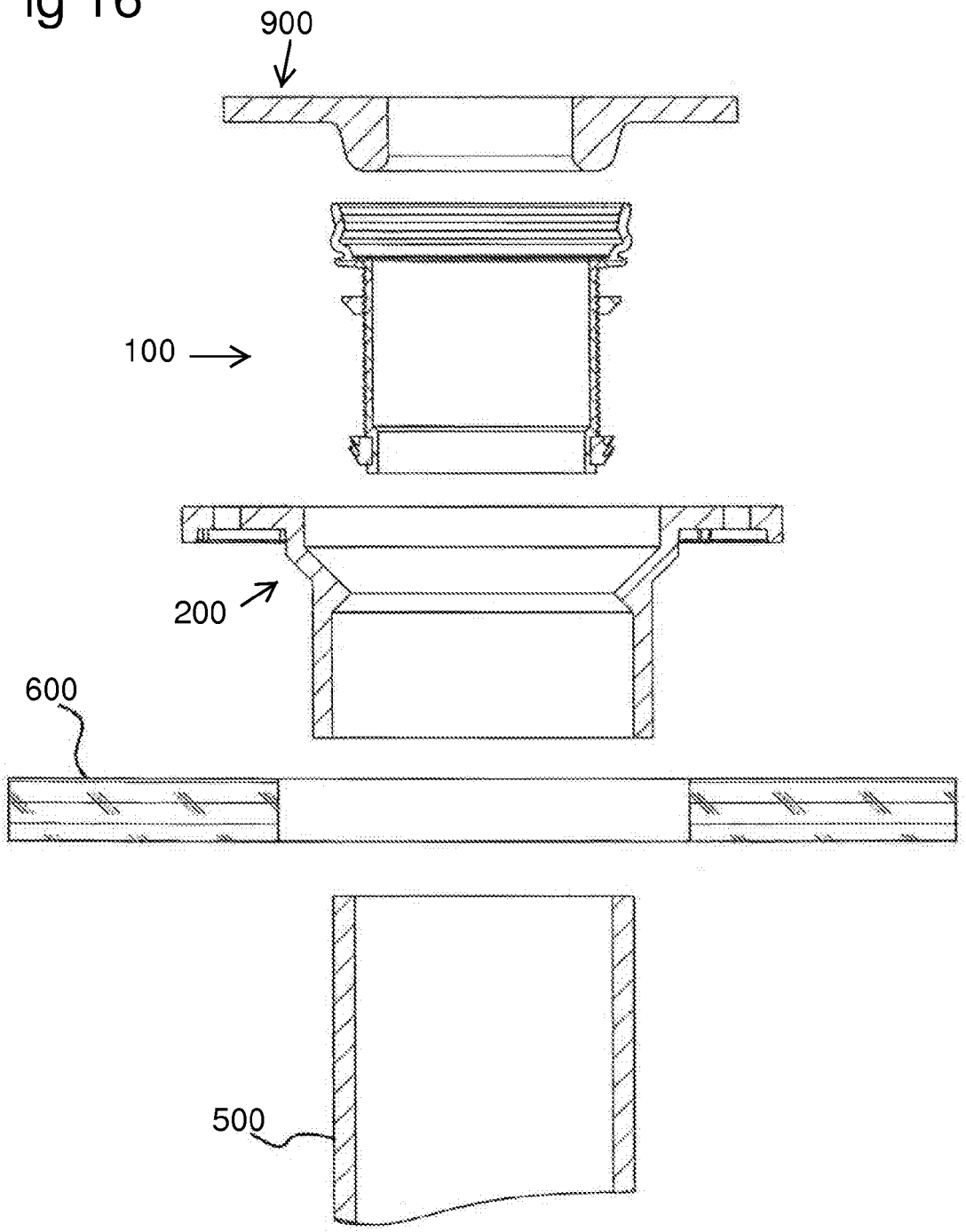
FIG. 16 depicts a disclosed new construction assembly

FIG. 16 depicts a new construction configuration using a disclosed threaded adapter sleeve 100 and male female pipe coupler 200.

Figure 17:
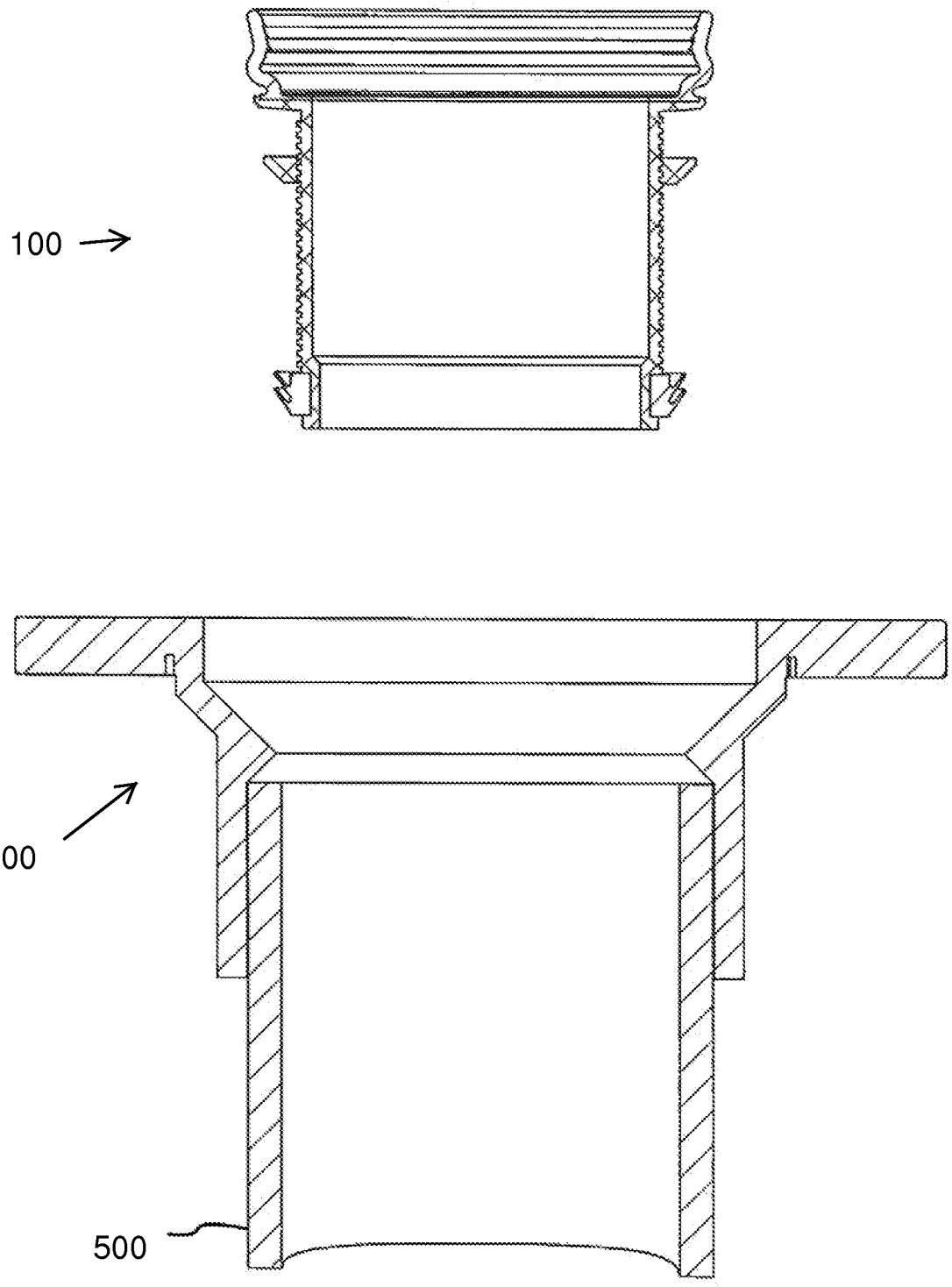
FIG. 17 depicts a threaded adapter sleeve and a male female pipe coupler

FIG. 17 depicts a threaded adapter sleeve 100 in position for insertion into a disclosed male female pipe coupler 200.

Figure 18:
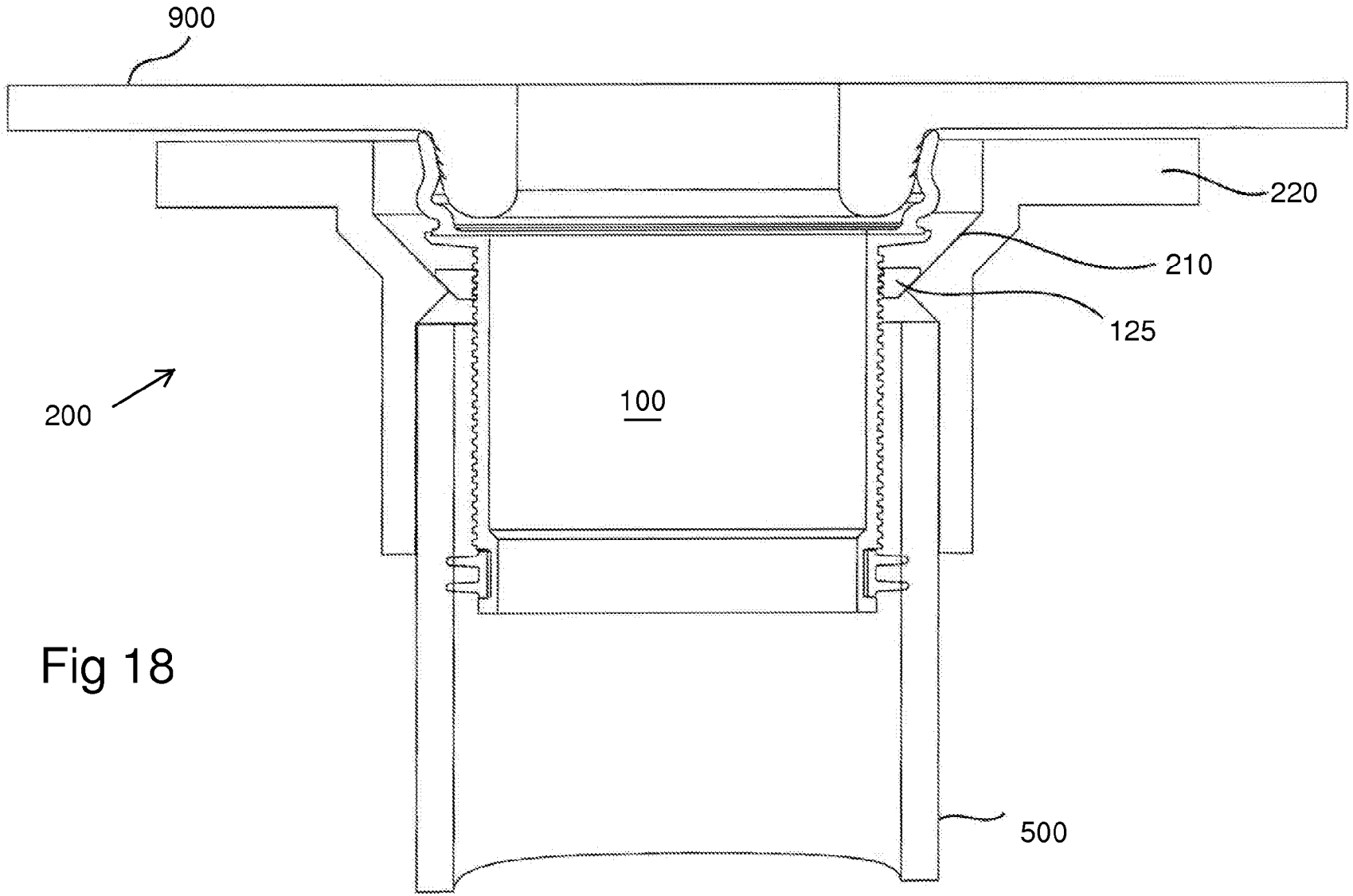
FIG. 18 depicts a new construction assembly

FIG. 18 depicts a new construction configuration.

Figure 19:
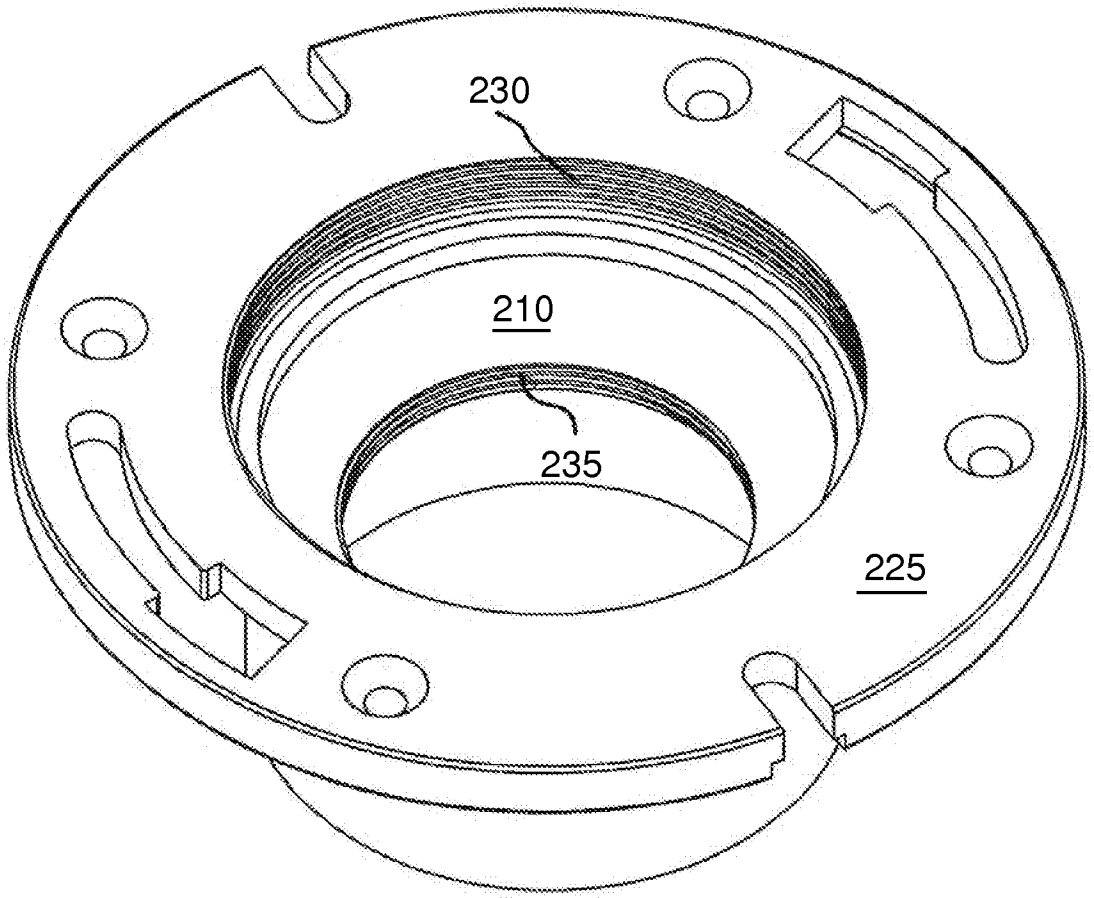
FIG. 19 depicts a male female pipe coupler

FIG. 19 depicts a top and side perspective view of a male female pipe coupler 200.

Figure 20:
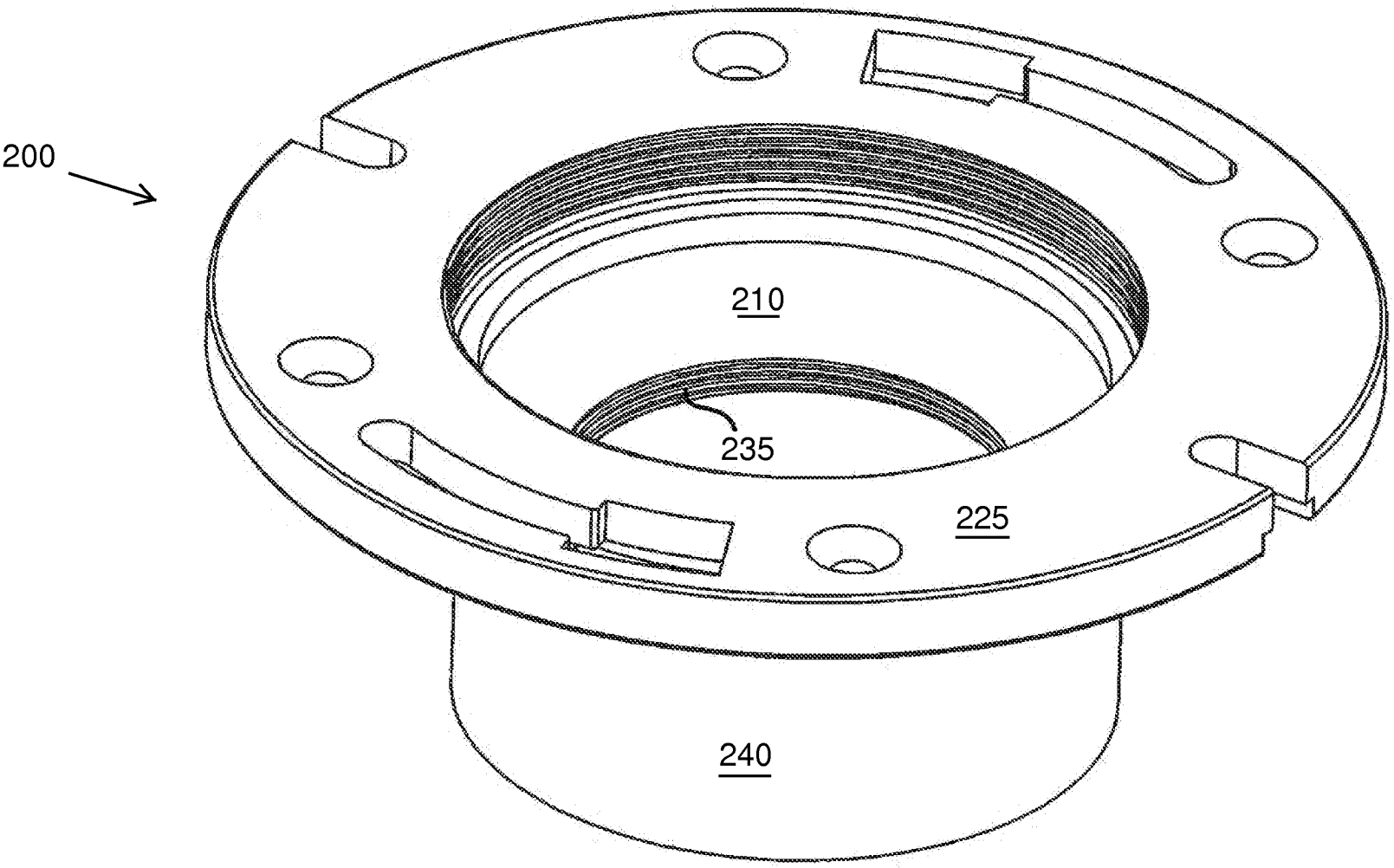
FIG. 20 depicts a depicts a male female pipe coupler

FIG. 20 depicts another view of a male female pipe coupler 200.

Figure 21:
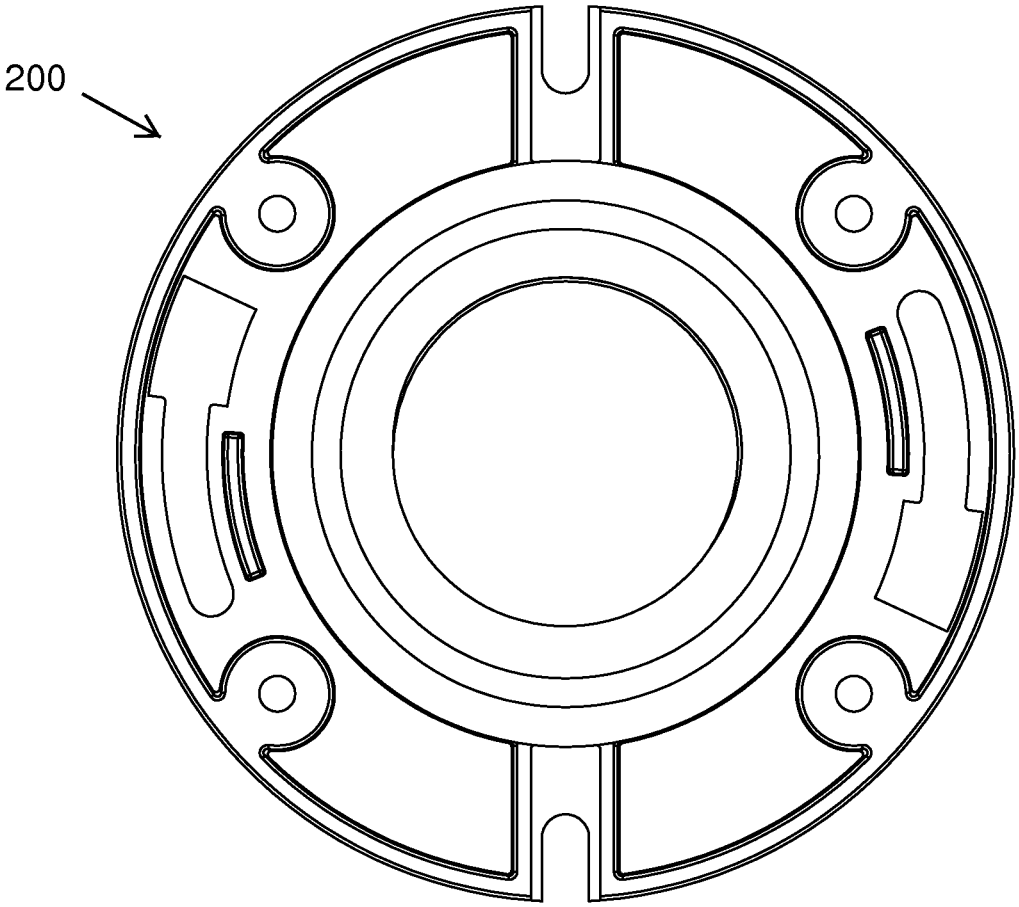
FIG. 21 depicts a bottom view of a male female pipe coupler

FIG. 21 depicts a bottom plan view of a male female pipe coupler 200.

Figure 22:
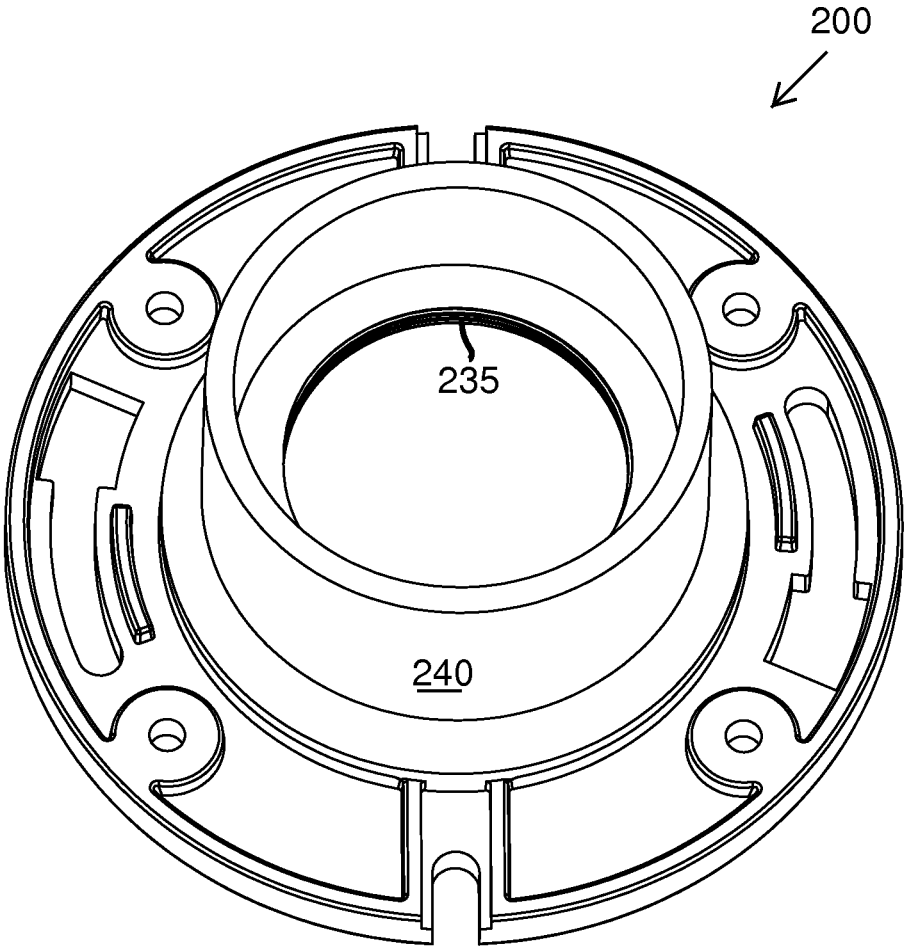
FIG. 22 depicts a bottom perspective view of a male female pipe coupler

FIG. 22 depicts a bottom perspective view of a male female pipe coupler 200.

Figure 23:
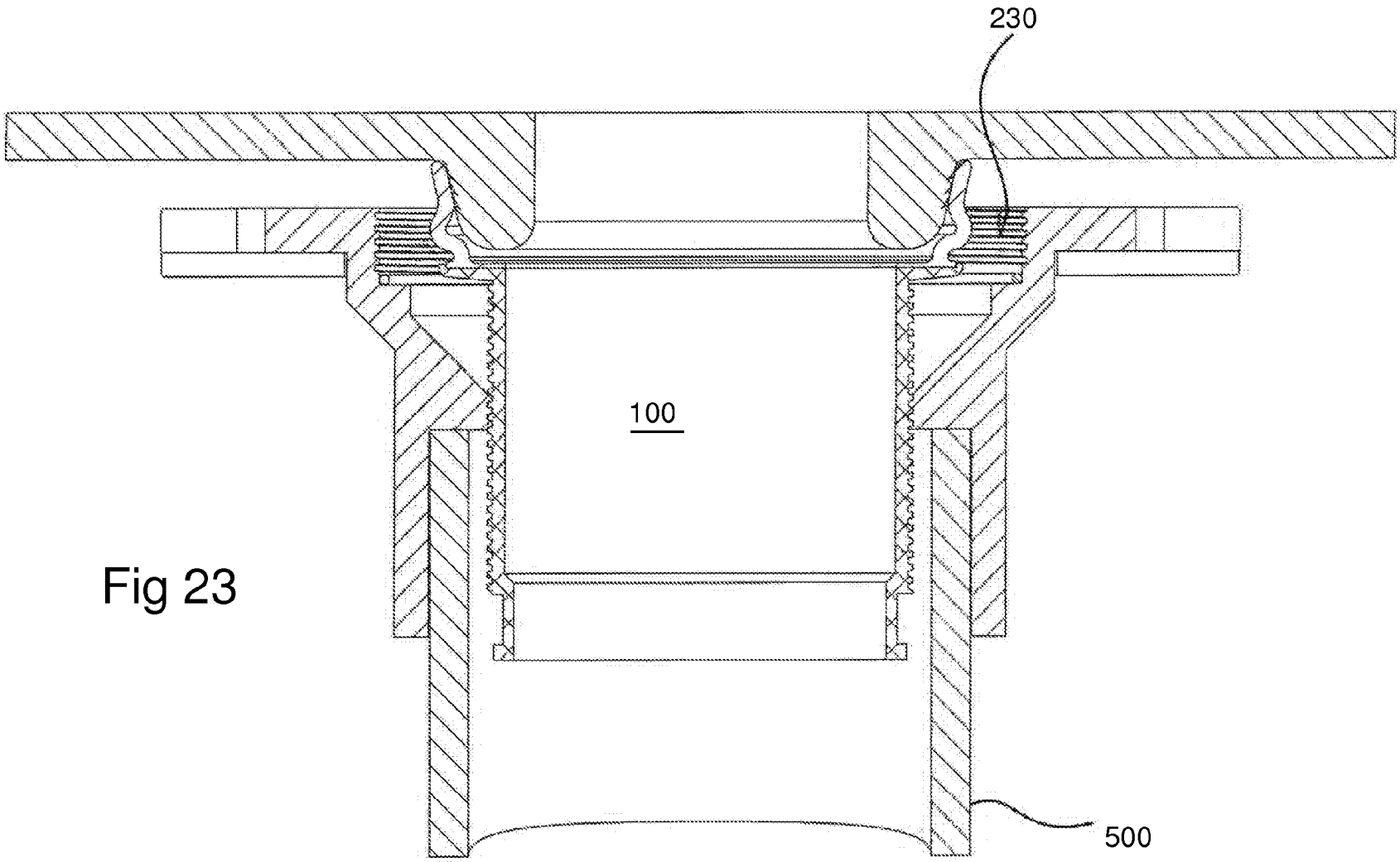
FIG. 23 depicts a section view of a male female pipe coupler and related components

FIG. 23 depicts a new construction configuration.

Figure 24:
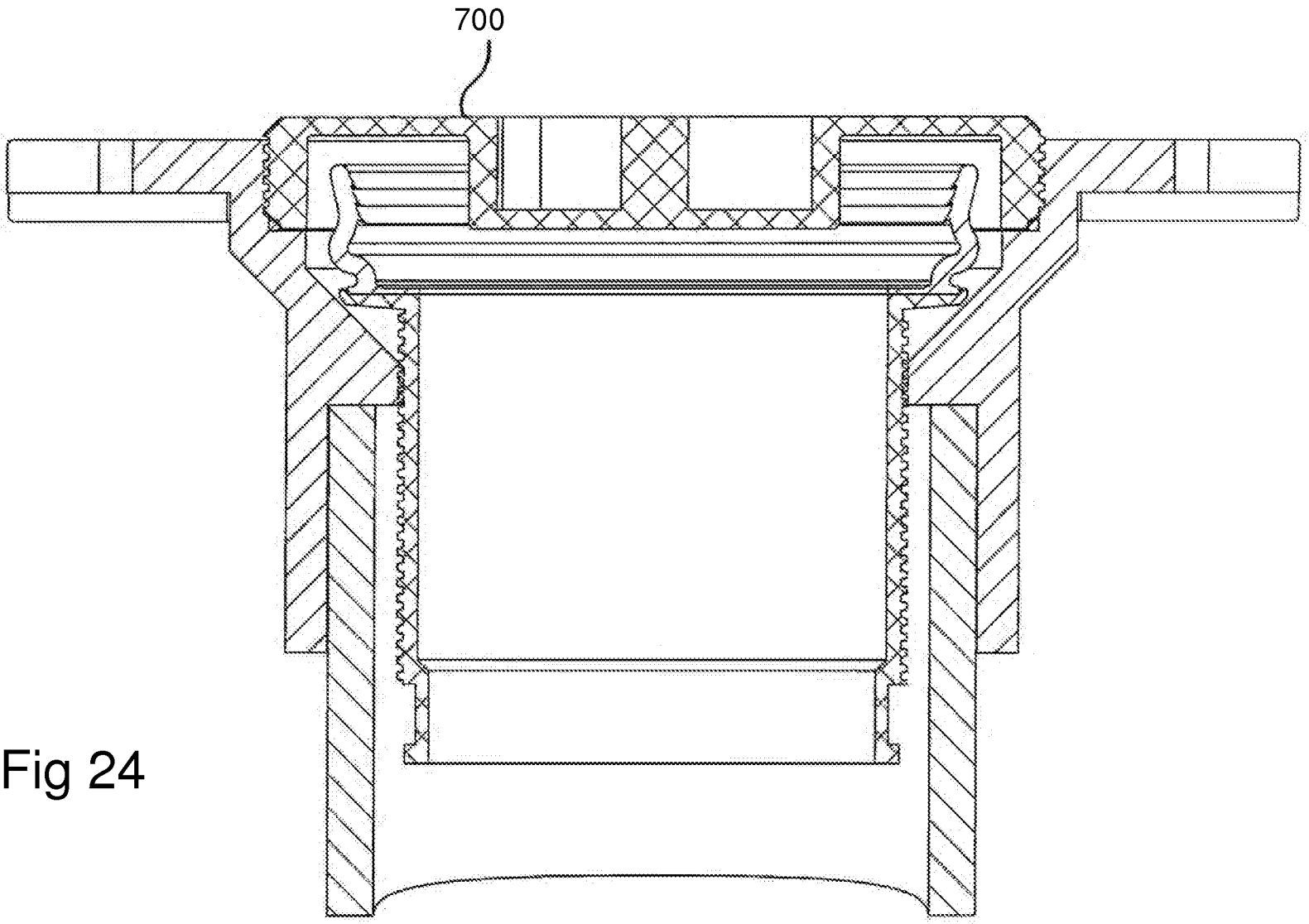
FIG. 24 depicts a pressure test cap and other components

FIG. 24 depicts a new construction configuration with a pressure test cap 700.

Items.

Disclosed embodiments include, but are not limited to the following items.

Item 1. A kit for use in either new construction or retro fit applications, the kit comprising:

a) a threaded adapter sleeve 100, the threaded adapter sleeve comprising a lower shoulder 111, a threaded body 110, a threaded seal holder 112, an upper shoulder 115, a seat seal area 116, an upper ledge 117, and a lower ledge 118;

b) a male female pipe coupler 200, comprising a tapered recess area 210, an upper shelf 220, an upper surface 225, upper threads 230, lower threads 235, a multi adapter collar.

The kit of item 1 further comprising:

a) a compact adjustment nut 125, the compact adjustment nut 125 comprising a recessed outer seat 126; the compact adjustment nut having inner threads configured to fit the threaded body 110 of the threaded adapter sleeve 100;

b) a compact seal 127 configured to fit within the seat seal area 116 of the threaded adapter sleeve 100;

c) a lip and valley expanded adjustment nut 128, comprising an upper shelf 150, a transition wall 151, a lower shelf 152, an inner void 155, threads 153 defined within the inner void, and an outer perimeter wall.

What is claimed is:

1. A kit for use in either new construction or retro fit applications, the kit comprising:

a) a threaded adapter sleeve, the threaded adapter sleeve comprising a lower shoulder, a threaded body, a threaded seal holder, an upper shoulder, a seat seal area, an upper ledge, and a lower ledge;

b) a male female pipe coupler, comprising a tapered recess area, an upper shelf, an upper surface, upper threads, lower threads, a multi adapter collar;

c) a compact adjustment nut, the compact adjustment nut comprising a recessed outer seat; the compact adjustment nut having inner threads configured to fit the threaded body of the threaded adapter sleeve;

d) a compact seal configured to fit within the seat seal area of the threaded adapter sleeve; and e) a lip and valley expanded adjustment nut, comprising an upper shelf, a transition wall, a lower self, an inner void, threads defined within the inner void, and an outer perimeter wall.

* * * * *